US005815192A

United States Patent [19]

Matsuo et al.

[11] Patent Number: 5,815,192

[45] Date of Patent: Sep. 29, 1998

[54] PRINTING APPARATUS HAVING PRINT HEAD TYPE DETECTION FOR INTERCHANGEABLE AND SELECTIVELY MOUNTED PRINT HEADS HAVING OPPOSITE SCAN DIRECTIONS

[75] Inventors: Tetsushi Matsuo, Tachikawa; Kazuo Matumoto, Ome, both of Japan

[73] Assignee: Kabushiki Kaisha TEC, Shizuoka, Japan

[21] Appl. No.: 667,620

[22] Filed: Jun. 21, 1996

[30] Foreign Application Priority Data

Jun. 29, 1995 [JP] Japan ..... 7-163797

[51] Int. Cl.[6] ..... B41J 2/45

[52] U.S. Cl. ..... 347/238; 347/117; 347/141; 347/166

[58] Field of Search ..... 347/117, 141, 347/166, 238

[56] References Cited

U.S. PATENT DOCUMENTS

| | | | |
|---|---|---|---|
| 4,872,027 | 10/1989 | Buskirk et al. | 346/140 R |
| 4,930,915 | 6/1990 | Kikuchi et al. | 400/175 |
| 5,049,904 | 9/1991 | Nakamura et al. | 346/140 R |
| 5,235,351 | 8/1993 | Koizumi | 346/140 R |
| 5,289,210 | 2/1994 | Takayanagi | 346/140 R |
| 5,363,134 | 11/1994 | Barbehenn et al. | 347/49 |
| 5,668,582 | 9/1997 | Manzone et al. | 347/49 |

FOREIGN PATENT DOCUMENTS

| | | | |
|---|---|---|---|
| 0195949 A3 | 10/1986 | European Pat. Off. | B41J 25/24 |
| 0274435 A2 | 7/1988 | European Pat. Off. | B41J 3/02 |
| 0274435 A3 | 7/1988 | European Pat. Off. | B41J 3/02 |
| 0315417 A2 | 5/1989 | European Pat. Off. | B41J 3/04 |
| 0315417 A3 | 5/1989 | European Pat. Off. | B41J 3/04 |
| 0647530 A2 | 4/1995 | European Pat. Off. | B41J 25/34 |

OTHER PUBLICATIONS

Patent Abstracts of Japan, vol. 10, No. 333 (M–534), Nov. 12, 1986 & JP–A–61 137756 (Cannon, Inc.) Jun. 25, 1986.

Patent Abstrracts of Japan, vol. 18, No. 526 (M–1683), Oct. 5, 1994 & JP–A–06 183057 (Toshiba Corp.) Jul. 5, 1994.

*Primary Examiner*—Jeffrey L. Sterrett

*Attorney, Agent, or Firm*—Frishauf, Holtz, Goodman, Langer & Chick

[57] ABSTRACT

A printing apparatus in which one of two types of printing heads with opposite scan directions is selectively mounted and the mounted printing head is supplied with printing data representing an image to be printed, thereby printing the image, includes a printing data transfer unit for transferring the printing data to the mounted printing head in one of an order from a beginning to an end of a scan line and an order from the end to the beginning of the scan line; a head recognition unit for recognizing the type of the mounted printing head; and a transfer control unit for enabling the printing data transfer unit to transfer the printing data in the order associated with the type of the mounted printing head recognized by the head recognition unit.

16 Claims, 8 Drawing Sheets

PRINTING APPARATUS HAVING PRINT HEAD TYPE DETECTION FOR INTERCHANGEABLE AND SELECTIVELY MOUNTED PRINT HEADS HAVING OPPOSITE SCAN DIRECTIONS

BACKGROUND OF THE INVENTION

1. Field of the Invention

The present invention relates to a printing apparatus, such as an electrophotographic printing apparatus, for printing an image by using a printing head such as an LED printing head.

2. Description of the Related Art

Recently, LED printing heads have widely been used more and more in exposing units of electrophotographic printing apparatuses.

An LED printing head comprises a number of LEDs arranged linearly at a predetermined density over a necessary printing width. Activation of each LED is controlled in accordance with one-line printing data. Thus, exposure of a photosensitive body is controlled in units of a dot.

There are various types of LED printing heads. For example, there are two driving methods for LEDs: a dynamic driving method and a static driving method. Thus, LED printing heads driven by the dynamic driving method and LED printing heads driven by the static driving method have been known.

In addition, there are LED printing heads with opposed scanning directions.

This being the case, in the prior art, an LED printing head to be used is first chosen, and then an electrophotographic printing apparatus is designed to match with the chosen LED printing head.

If the electrophotographic printing apparatus is designed to match with only one type of LED printing head, another type of LED printing head cannot be used in the printing apparatus. Even if a defect occurs in the LED printing head set in the apparatus or shortage occurs in supply of printing heads, the LED printing head cannot be replaced with another type of head, and the electrophotographic printing apparatus cannot be constructed with use of such another type of head.

This problem is not limited to the electrophotographic printing apparatus using the LED printing head. The same problem occurs in another type of printing apparatus such as a thermal printing apparatus using a thermal printing head.

SUMMARY OF THE INVENTION

The present invention has been made in consideration of the above circumstances, and its object is to provide a printing apparatus capable of printing an image by selectively using one of a plurality of types of printing heads.

This object can be achieved by a printing apparatus in which one of a plurality of types of printing heads is selectively mounted and the selected printing head is used to print an image, the printing apparatus comprising:

head control means, having control modes associated respectively with the plurality of types of printing heads, for controlling the operation of the mounted printing head to print the image;

head recognition means for recognizing the type of the mounted printing head; and control mode selection means for selecting the control mode associated with the type recognized by the head recognition means, thereby enabling the head control means to operate in the selected control mode.

The object can also be achieved by a printing apparatus in which one of two types of printing heads with opposite scan directions is selectively mounted and the mounted printing head is supplied with printing data representing an image to be printed, thereby printing the image, the printing apparatus comprising:

printing data transfer means for transferring the printing data to the mounted printing head in one of an order from the top to the end of a scan line and an order from the end to the top of the scan line;

head recognition means for recognizing the type of the mounted printing head; and transfer control means for enabling the printing data transfer means to transfer the printing data in the order associated with the type recognized by the head recognition means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

(First Embodiment)

A first embodiment of the present invention will now be described with reference to the accompanying drawings.

Figure 1:
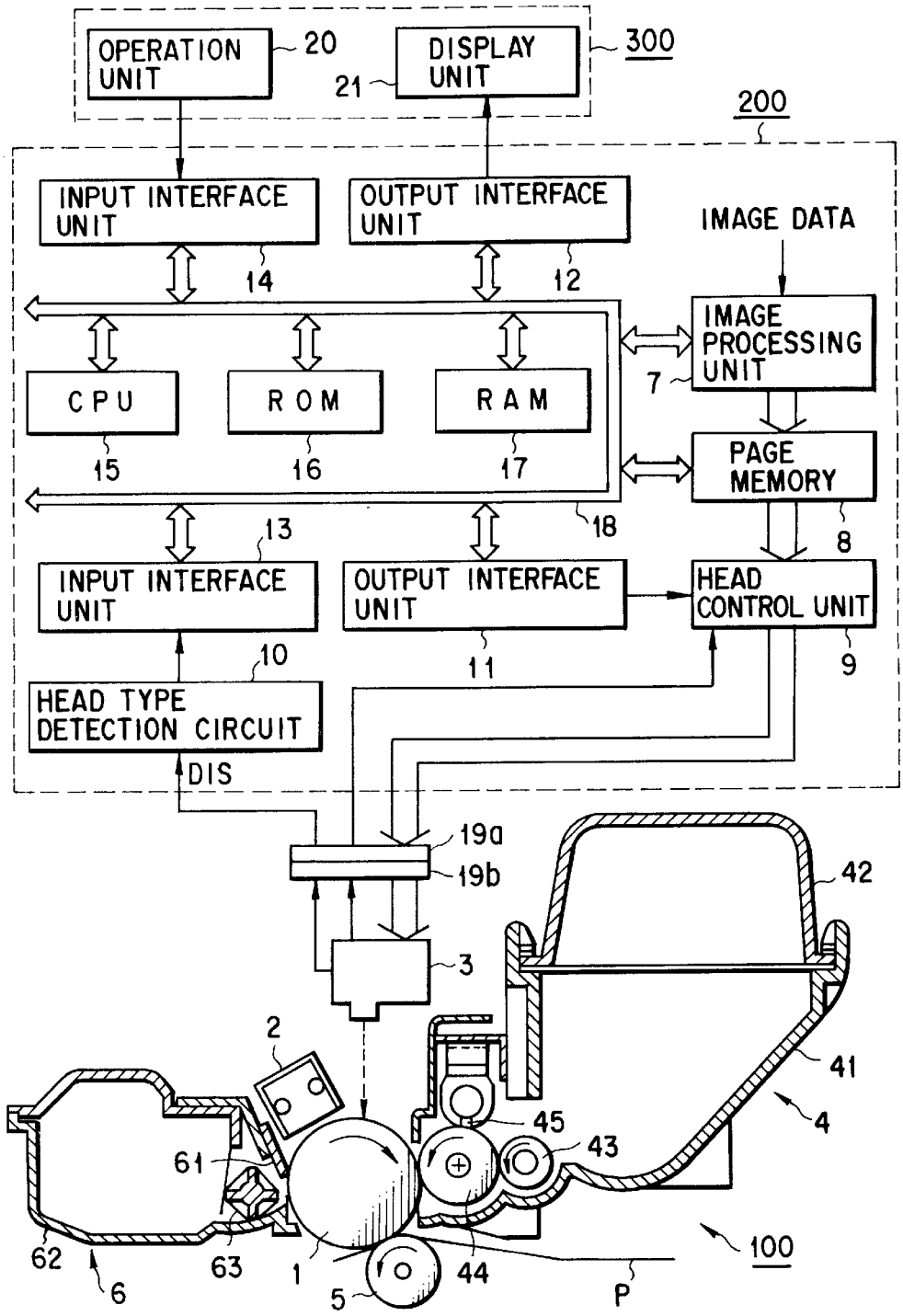
FIG. 1 shows the structure a main part of an electrophotographic printing apparatus according to a first embodiment of the present invention.

FIG. 1 shows the structure of a main part of an electrophotographic printing apparatus according to the first embodiment of the invention.

As is shown in FIG. 1, the electrophotographic printing apparatus according to this embodiment comprises an electrophotographic processing mechanism 100, a printing head control system 200 and an operation panel 300.

The electrophotographic processing mechanism 100 comprises a photosensitive drum 1, a charger 2, an LED printing head 3, a developing device 4, a transfer roller 5 and a cleaning device 6.

The photosensitive drum 1 is constructed such that a photosensitive conductive material, which will become a photosensitive layer, is coated on the outer peripheral surface of a conductor such as aluminum. The photosensitive drum 1 is rotated in the direction of an arrow indicated in FIG. 1 by a driving force transmission mechanism (not shown). The outer peripheral surface of the photosensitive drum 1 is surrounded by the charger 2, LED printing head 3, developing device 4, transfer roller 5 and cleaning device 6.

The charger 2 comprises, e.g. a conventional scorotron charger and uniformly charges the surface of the photosensitive drum 1 at a predetermined potential (e.g. −600V).

The LED printing head 3 comprises a number of LEDs arranged linearly over a distance corresponding to the width of the photosensitive drum 1 at a predetermined density (e.g. 400/in). The surface of the photosensitive drum 1 is exposed to light emitted from each LED of the LED printing head 3. Thus, an electrostatic latent image is formed on the surface of the photosensitive drum 1.

The developing device 4 develops the electrostatic latent image formed on the surface of the photosensitive drum 1 by means of toner, thereby producing a toner image (visible image). The developing device 4 comprises a toner hopper 41, a toner pack 42, a supply roller 43, a developing roller 44 and a developing blade 45.

The transfer roller 5 is situated in parallel to the photosensitive drum 1. A transfer voltage having a polarity opposite to the polarity of toner charge potential and having a predetermined value (e.g. +1350V) is applied from a transfer power supply (not shown) to the transfer roller 5, thereby to transfer a toner image formed on the photosensitive drum 1 onto a printing paper sheet P inserted between the transfer roller 5 itself and the photosensitive drum 1.

The cleaning device 6 comprises a cleaning blade 61, a waste toner container 62 and a waste toner roller 63. The cleaning device 6 removes from the photosensitive drum 1 the toner not transferred onto the paper sheet P and remaining on the surface of the photosensitive drum 1.

The printing head control system 200 is connected to the LED printing head 3 via connectors 19*a* and 19*b* and controls the LED printing head 3. The printing head control system 200 comprises an image processing unit 7, a page memory 8, a head control unit 9, a head type detection circuit 10, output interface units 11 and 12, input interface units 13 and 14, a central processing unit (CPU) 15, a read-only memory (ROM) 16 and a random access memory (RAM) 17. The image processing unit 7, page memory 8, output interface units 11 and 12, input interface units 13 and 14, CPU 15, ROM 16 and RAM 17 are connected to one another by means of a system bus 18 comprising a data bus, an address bus and a control bus.

The image processing unit 7 receives image data to be printed from the outside. On the basis of the image data, the image processing unit 7 generates printing data for driving the LED printing head 3.

The page memory 8 stores the printing data generated by the image processing unit 7.

The head control unit 9 produces a predetermined control signal for driving the LED printing head 3.

The head type detection circuit 10 receives a discrimination signal from the LED printing head 3 via the connectors 19*a* and 19*b*. On the basis of the discrimination signal, the head type detection circuit 10 detects the type of the LED printing head 3, and informs the CPU 15 of the detected type of LED printing head 3.

The output interface unit 11 outputs to the head control unit 9 a signal corresponding to command data output from the CPU 15 in order to control the operation of the head control unit 9.

The other output interface unit 12 outputs to a display unit 21 provided in the operation panel 300 a signal corresponding to command data output from the CPU 15 in order to control the operation of the display unit 21.

The input interface unit 13 receives an output signal from the head type detection circuit 10 and supplies the received signal to the system bus 18 in accordance with a command from the CPU 15.

The other input interface unit 14 receives an output signal from an operation unit 20 provided in the operation panel 300 and supplies the received signal to the system bus 18 in accordance with a command from the CPU 15.

The CPU 15 operates in accordance with operation programs stored in the ROM 16 and controls the operations of the respective elements, thereby effecting the total operation of the electrophotographic printing apparatus. The CPU 15 changes the operation mode of the head control unit 9 in accordance with the type of the LED printing head 3, of which the CPU 15 is informed by the head type detection circuit 10.

The ROM 16 stores in a fixed fashion the operation programs for the CPU 15 and other information necessary for various processing performed by the CPU 15.

The RAM 17 temporarily stores various data necessary for various processing performed by the CPU 15.

The operation panel 300 comprises the operation unit 20 and display unit 21. By means of the operation unit 20, the user provides the CPU 15 with various operation commands. The display unit 21 displays various information to the user under the control of the CPU 15.

Figure 2:
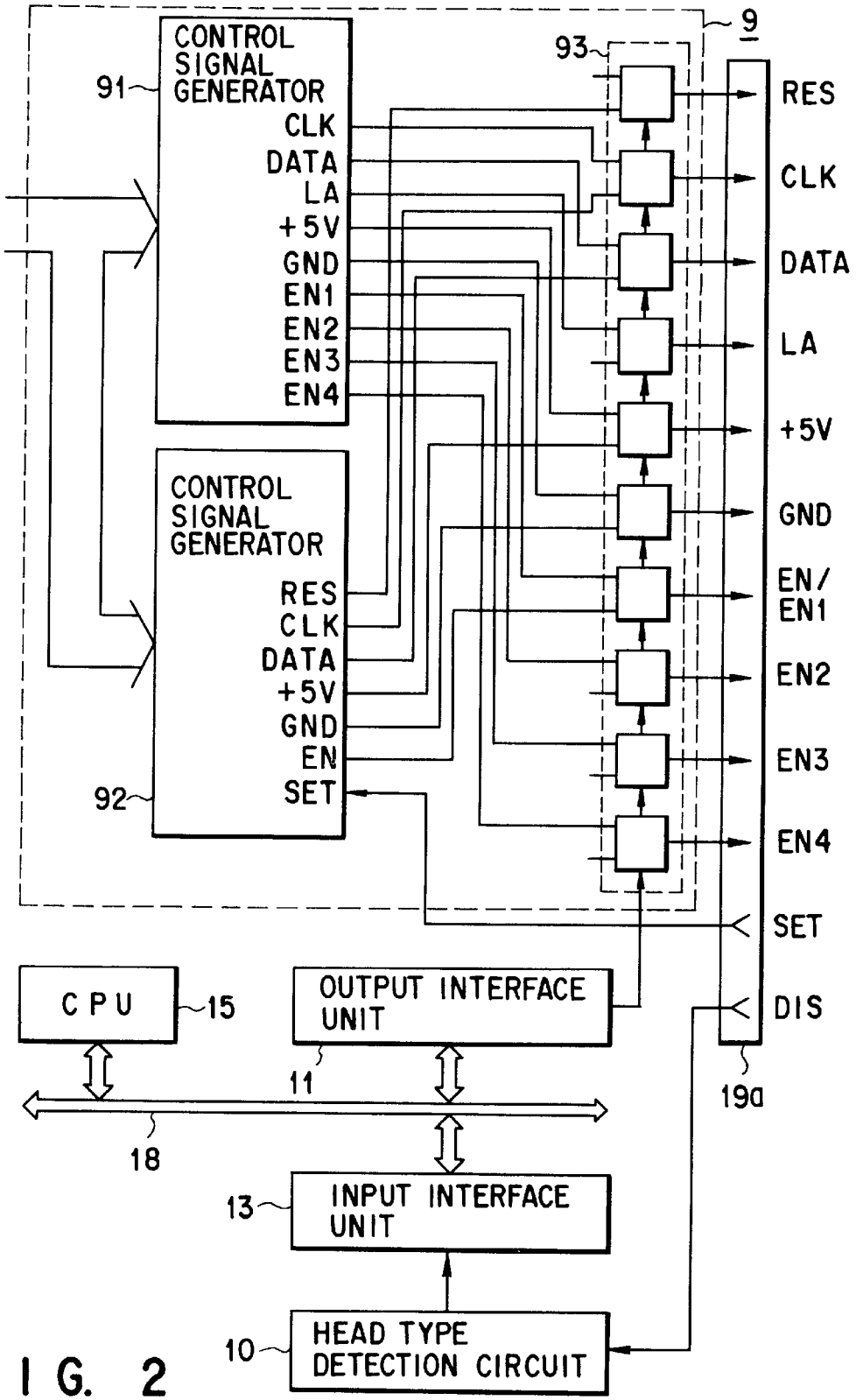
FIG. 2 is a block diagram showing a specific structure of a head control unit in FIG. 1.

FIG. 2 is a block diagram showing the specific structure of the head control unit 9. As is shown in FIG. 2, the head control unit 9 comprises two control signal generators 91 and 92 and a selector 93. The control signal generator 91 generates control signals (clock signal CLK, printing data DATA, latch signal LA, and enable signals EN1 to EN4) necessary for controlling a dynamic drive type LED printing head. The control signal generator 92 generates control signals (reset signal RES, clock signal CLK, printing data DATA, and enable signal EN) necessary for controlling a static drive type LED printing head. The selector 93 selects one of control signals output from the control signal generators 91 and 92 under the control of the CPU 15 and outputs the selected control signal to the connector 19*a*.

The connector 19*a* is provided with a reset signal terminal, a clock signal terminal, a printing data terminal, a latch signal terminal, a power supply line connection terminal, a ground connection terminal, four enable signal terminals, a status signal terminal, and a discrimination signal terminal, and a corresponding signal is supplied from the selector 93 (e.g. one of clock signals CLK output from the control signal generators 91 and 92 is supplied to the clock signal terminal).

Figure 3:
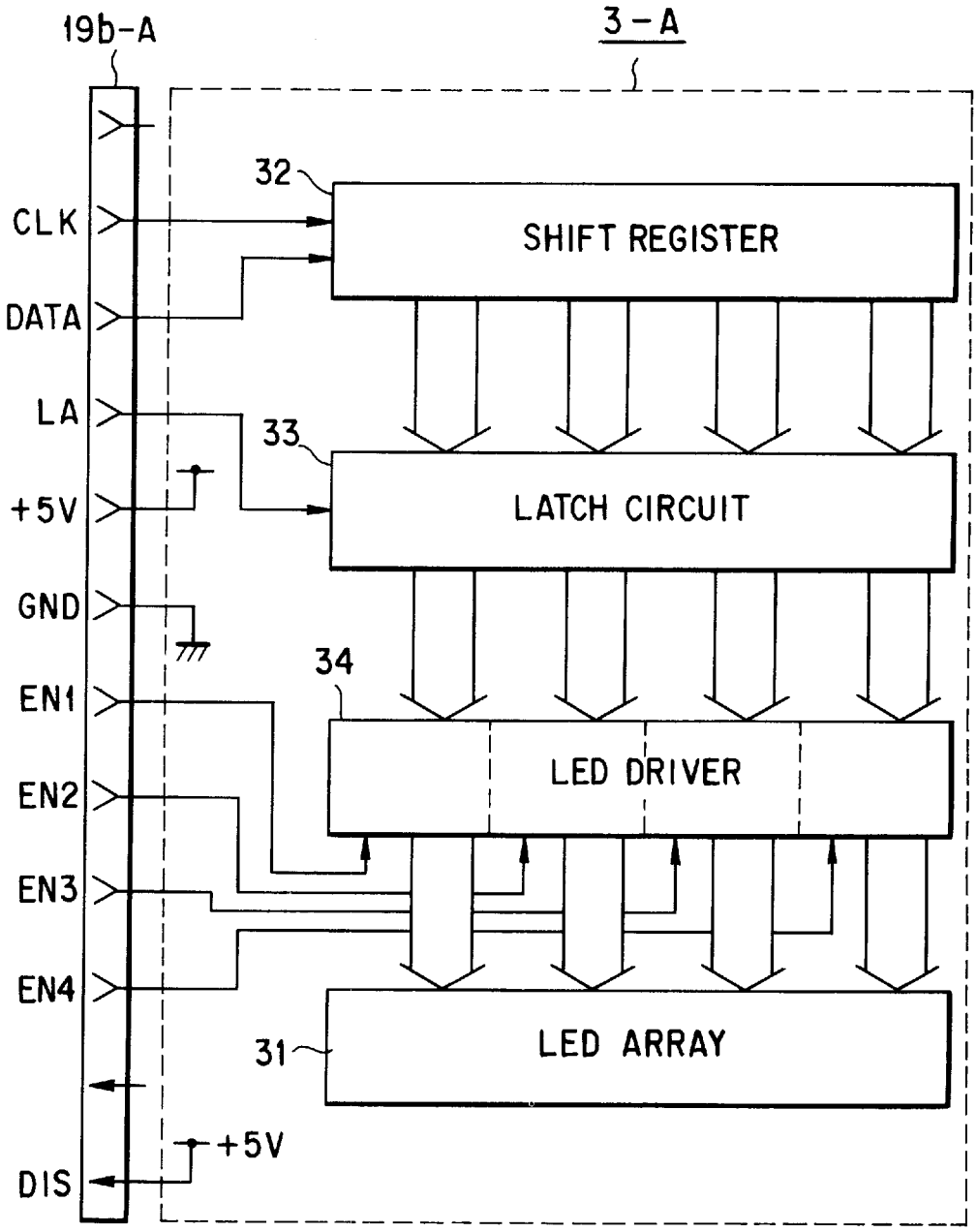
FIG. 3 is a block diagram showing the structure of a static type head.

FIG. 3 is a block diagram showing the structure of a static drive type LED printing head (hereinafter referred to as "static type head") 3-A. The static type head 3-A, as shown in FIG. 3, comprises an LED array 31, a shift register 32, a latch circuit 33 and an LED driver 34. The LED array 31 comprises a number of LEDs linearly arranged at a predetermined density over a distance corresponding to the width of the photosensitive drum 1. The shift register 32 drives the LED array 31 in accordance with control signals supplied from the head control unit 9.

When the static type head 3-A is mounted in the electrophotographic printing apparatus as LED printing head 3, the static type head 3-A is connected to the head control unit 9 by coupling the connector 19*a* and connector 19*b* (hereinafter, the connector 19*b* of the static type head 3-A is referred to as "connector 19*b*-A" for the purpose of clear distinction). Thus, the static type head 3-A receives control signals from the head control unit 9.

The connector 19*b*-A is provided with terminals corresponding to the terminals of the connector 19*a*, and the static type head 3-A can receive signals from the head control unit 9 via the terminals of the connector 19*a*. Of the received signals, the clock signal CLK supplied via the clock signal terminal and the printing data DATA supplied via the printing data terminals are input to the shift register 32. The latch signal LA supplied via the latch signal terminal is input to the latch circuit 33. The enable signals EN1 to EN4 supplied via the four enable signal terminals are input to the LED driver 34.

The power supply line connection terminal is connected to a power supply line connected to each element in the static type head 3-A. The ground connection terminal is connected to a ground line connected to each element in the static type head 3-A. The discrimination signal terminal is connected to a line of +5V within the static type head 3-A. The reset signal terminal and status signal terminal are not used.

The shift register 32 receives printing data DATA for one line, which is supplied as serial data, and outputs the printing data DATA to the latch circuit 33 as parallel data.

The latch circuit 33 receives and latches the data output from the shift register 32 in synchronism with the latch signal LA. The latch circuit 33 delivers the latched data to the LED driver 34 as parallel data.

The LED driver 34 includes drivers associated with the LEDs of the LED array 31. Each driver turns on/off the associated LED in accordance with each bit of the parallel data output from the latch circuit 33. The drivers of the LED driver 34 are divided into four blocks. The drivers of the first block turn on/off the associated LEDs when the enable signal EN1 is at "H" level; the drivers of the second block turn on/off the associated LEDs when the enable signal EN2 is at "H" level; the drivers of the third block turn on/off the associated LEDs when the enable signal EN3 is at "H" level; and the drivers of the fourth block turn on/off the associated LEDs when the enable signal EN4 is at "H" level.

Figure 4:
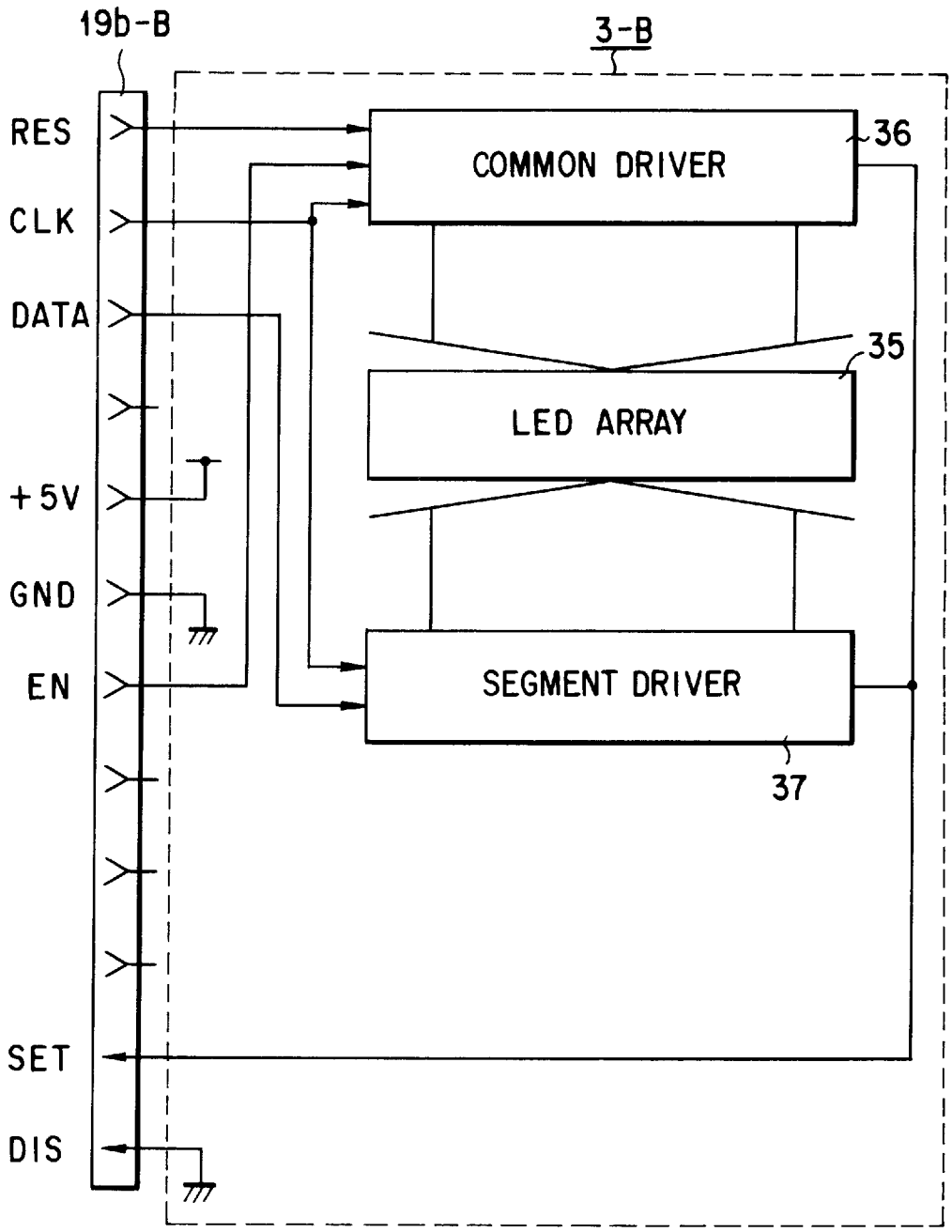
FIG. 4 is a block diagram showing the structure of a dynamic type head.

FIG. 4 is a block diagram showing the structure of a dynamic drive type LED printing head (hereinafter referred to as "dynamic type head") 3-B. The dynamic type head 3-B, as shown in FIG. 4, comprises an LED array 35, a common driver 36 and a segment driver 37. The LED array 35 comprises a number of LEDs linearly arranged at a predetermined density over a distance corresponding to the width of the photosensitive drum 1. The common driver 36 and segment driver 37 drive the LED array 35 in accordance with control signals supplied from the head control unit 9.

When the dynamic type head 3-B is mounted in the electrophotographic printing apparatus as LED printing head 3, the dynamic type head 3-B is connected to the head control unit 9 by coupling the connector 19*a* and connector 19*b* (hereinafter, the connector 19*b* of the dynamic type head 3-B is referred to as "connector 19*b*-B" for the purpose of clear distinction). Thus, the dynamic type head 3-B receives control signals from the head control unit 9.

The connector 19*b*-B is provided with terminals corresponding to the terminals of the connector 19*a*, and the dynamic type head 3-B can receive signals from the head control unit 9 via the terminals of the connector 19*a*. Of the received signals, the reset signal supplied via the reset signal terminal RES and the enable signal EN supplied via the enable signal terminal are input to the common driver 36. The clock signal CLK supplied via the clock signal terminal is delivered to both the common driver 36 and segment driver 37. The printing data DATA supplied via the printing data terminal is input to the segment driver 37.

The power supply line connection terminal is connected to a power supply line connected to each element in the dynamic type head 3-B. The ground connection terminal is connected to a ground line connected to each element in the dynamic type head 3-B. The discrimination signal terminal is grounded within the dynamic type head 3-B. The status signal terminal is supplied with a status signal SET output from the common driver 36 and segment driver 37. The latch signal terminal and the other three enable signal terminals are not used.

The common driver 36 divides the LEDs of the LED array 35 into 32 blocks and supplies a driving current to each block in a time-sharing manner.

The segment driver 37 divides the printing data into 32 blocks and turns on/off each of the LEDs associated with each block on the basis of the printing data DATA of each block. Specifically, the segment driver 37 simultaneously turns on/off the LEDs associated with each block on the basis of the printing data DATA of the associated single block.

The operation of the electrophotographic printing apparatus having the above structure will now be described.

Figure 5:
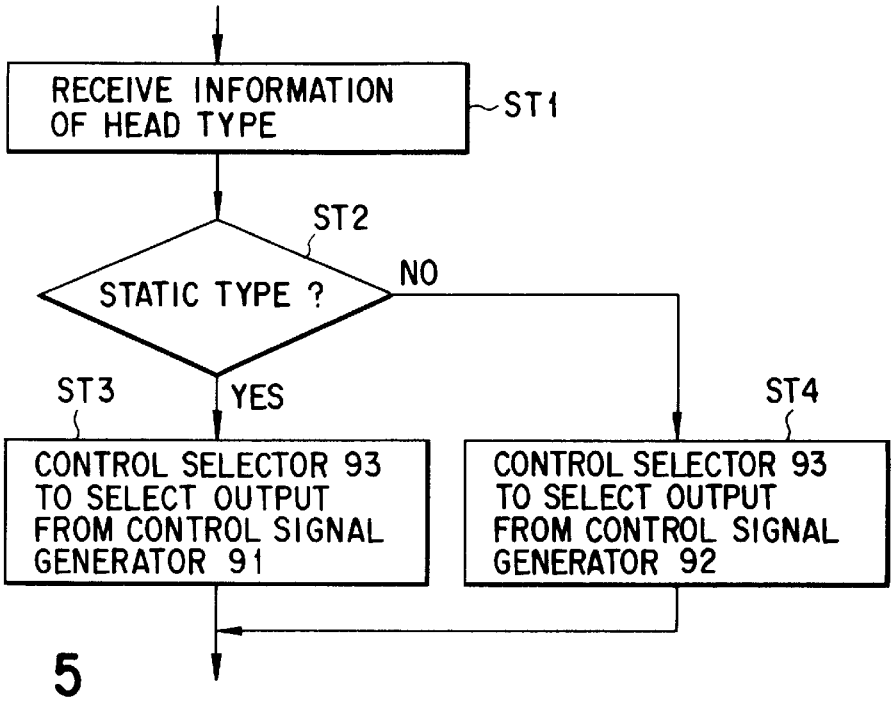
FIG. 5 is a flowchart illustrating the operational procedure of a CPU in FIG. 1.

At a predetermined time, e.g. at the time of turn-on of power, the CPU 15 receives information from the head type detection circuit 10 (step ST1 in FIG. 5). On the basis of the received information, the CPU 15 determines whether the mounted LED printing head 3 is of the static type (step ST2 in FIG. 5). If the mounted LED printing head 3 is of the static type, the CPU 15 controls the selector 93 to select the output from the control signal generator 91 (step ST3 in FIG. 5). If the mounted LED printing head 3 is not of the static type, the CPU 15 controls the selector 93 to select the output from the control signal generator 92 (step ST4 in FIG. 5).

During the above control by the CPU 15, the respective parts of the apparatus perform the following operations. Specifically, the head type detection circuit 10 receives the discrimination signal DIS from the mounted LED printing head 3, detects whether the level of the signal DIS is at "H" level or "L" level, and outputs the detection result.

If the static type head 3-A is mounted as LED printing head 3, the static type head 3-A outputs the discrimination signal DIS of +5V, i.e. "H" level. At this time, the head type detection circuit 10 detects that the discrimination signal DIS is at "H" level and informs the CPU 15 to that effect. Then, the CPU 15 controls the selector 93 to select and output the control signal from the control signal generator 91, as mentioned above.

If a need to print an image arises in this state, the image processing unit 7 generates printing data on the basis of image data supplied from the outside. The generated printing data is temporarily stored in the page memory 8 and then supplied to the head control unit 9.

In the head control unit 9, both the control signal generators 91 and 92 receive the printing data and generate the respective control signals. The control signal generators 91 and 92 output the signals and printing data at a predetermined timing.

In this case, however, since the selector 93 selects the output from the control signal generator 91, the static type head 3-A receives the clock signal CLK, printing data DATA, latch signal LA and enable signals EN1 to EN4 output from the control signal generator 91. In other words, all the signals necessary for the static drive method are supplied to the static type head 3-A. Accordingly, the static type head 3-A is controlled in the static drive method and properly driven. Thus, the exposure process is performed.

In this case, the other parts of the electrophotographic processing mechanism 100 are operated in the conventional operation mode. Thereby, the image is printed.

On the other hand, if the dynamic type head 3-B is mounted as LED printing head 3, the dynamic type head 3-B outputs the discrimination signal DIS of a ground level, i.e. "L" level. At this time, the head type detection circuit 10 detects that the discrimination signal DIS is at "L" level and informs the CPU 15 to that effect. Then, the CPU 15 controls the selector 93 to select and output the control signal from the control signal generator 92, as mentioned above.

If a need to print an image arises in this state, both the control signal generators 91 and 92 receive the printing data, as described above, and generate the respective control signals. The control signal generators 91 and 92 output the signals and printing data at a predetermined timing.

In this case, however, since the selector 93 selects the output from the control signal generator 92, the dynamic type head 3-B receives the reset signal RES, clock signal CLK, printing data DATA, and enable signal EN output from the control signal generator 92. In other words, all the signals necessary for the dynamic drive method are supplied to the dynamic type head 3-B. Accordingly, the dynamic type head 3-B is controlled in the dynamic drive method and properly driven. Thus, the exposure process is performed.

In this case, the other parts of the electrophotographic processing mechanism 100 are operated in the conventional operation mode. Thereby, the image is printed.

According to the present embodiment, as has been described above, the head control unit 9 comprises the control signal generator 91 for generating the signals necessary for the static drive method, the control signal generator 92 for generating the signals necessary for the dynamic drive method, and the selector 93 for selecting outputting the outputs from the control signal generators 91 and 92. The head type detection circuit 10 automatically detects, on the basis of the discrimination signal DIS output from the LED printing head 3, whether the static type head 3-A or dynamic type head 3-B is mounted as LED printing head 3. When the static type head 3-A is mounted, the CPU 15 controls the selector 93 so that the signals necessary for the static drive method, which are generated by the control signal generator 91, are delivered to the LED printing head 3. When the dynamic type head 3-B is mounted, the CPU 15 controls the selector 93 so that the signals necessary for the dynamic drive method, which are generated by the control signal generator 92, are delivered to the LED printing head 3.

Whichever type of LED printing head 3, static type head 3-A or dynamic type head 3-B, is mounted, the LED printing head 3 can be properly controlled. Thus, either the static type head 3-A or dynamic type head 3-B may be freely used as LED printing head 3. Even if shortage of supply of one of the two types of LED printing head 3 occurs, the other type can be substituted.

Furthermore, in the above embodiment, the type of LED printing head 3 is automatically recognized and the control signals are automatically switched properly. Therefore, the LED printing head 3 can always be driven by proper control signals in accordance with the type.

(Second Embodiment)

A second embodiment of the present invention will now be described.

Figure 6:
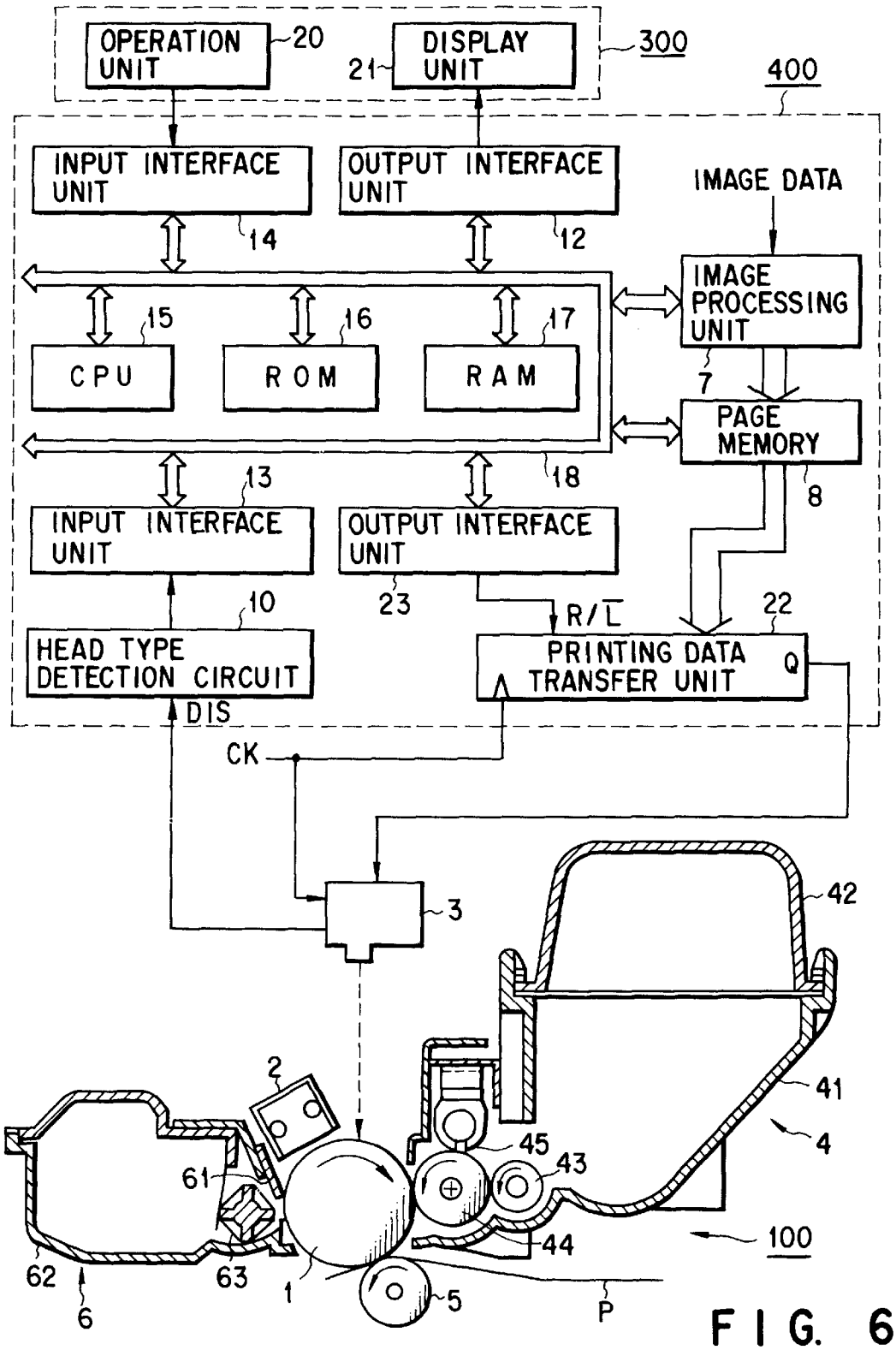
FIG. 6 shows the structure of a main part of an electrophotographic printing apparatus according to a second embodiment of the present invention.

FIG. 6 shows the structure a main part of an electrophotographic printing apparatus according to the second embodiment of the present invention. The structural elements common to those shown in FIG. 1 are denoted by like reference numerals and a detailed description thereof is omitted.

This electrophotographic printing apparatus comprises an electrophotographic processing mechanism 100, an operation panel 300 and a printing head control system 400.

The printing head control system 400 is connected to the LED printing head 3 and controls the LED printing head 3. The printing head control system 400 comprises an image processing unit 7, a page memory 8, a head type detection circuit 10, an output interface unit 12, input interface units 13 and 14, a CPU 15, a ROM 16, a RAM 17, a printing data transfer unit 22 and an output interface unit 23. The image processing unit 7, page memory 8, output interface unit 12, input interface units 13 and 14, CPU 15, ROM 16, RAM 17 and output interface unit 23 are connected to one another by means of a system bus 18. Although not shown, the printing head control system 400 includes a section for generating a predetermined control signal such as an enable signal and supplying it to the LED printing head 3.

The printing data transfer unit 22 receives from the page memory 8 printing data for one line and transfers the printing data to the LED printing head 3. The printing data transfer unit 22 comprises a bi-directional shift register. When a transfer direction designation signal is at "L" level, the printing data transfer unit 22 transfers the printing data in a forward direction. When the transfer direction designation signal is at "H" level, the printing data transfer unit 22 transfers the printing data in a reverse direction.

The output interface unit 23 outputs to the printing data transfer unit 22 a signal corresponding to command data which is output from the CPU 15 in order to control the operation of the printing data transfer unit 22.

The CPU 15 and ROM 16 are the same as those in the first embodiment. The operation programs stored in the ROM 16, however, differ from those in the first embodiment, and accordingly the CPU 15 operates in a different manner.

The CPU 15 operates in accordance with operation programs stored in the ROM 16 and controls the operations of the respective elements, thereby effecting the total operation of the electrophotographic printing apparatus. The operation of the CPU 15 is substantially the same as that in the first embodiment. In the second embodiment, however, the CPU 15 delivers to the printing data transfer unit 22 a transfer direction designation signal corresponding to the type of the LED printing head 3, of which the CPU 15 is informed by the head type detection circuit 10. Thus, the CPU 15 controls the printing data transfer direction in the printing data transfer unit 22.

The operation of the electrophotographic printing apparatus having the above structure will now be described.

Figure 7:
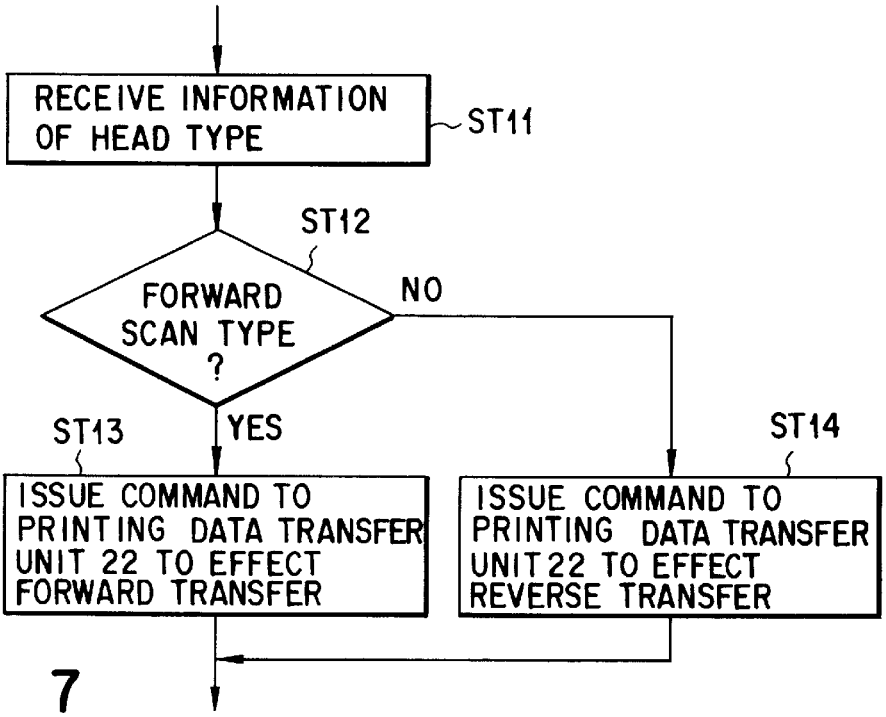
FIG. 7 is a flowchart illustrating the operational procedure of a CPU in FIG. 6.

At a predetermined time, e.g. at the time of turn-on of power, the CPU 15 receives information from the head type detection circuit 10 (step ST11 in FIG. 7). On the basis of the received information, the CPU 15 determines whether the mounted LED printing head 3 is of the forward scan type (step ST12 in FIG. 7). If the mounted LED printing head 3 is of the forward scan type, the CPU 15 issues to the printing data transfer unit 22 a transfer direction designation signal for designating forward transfer (step ST13 in FIG. 7). If the mounted LED printing head 3 is not of the forward scan type, the CPU 15 issues to the printing data transfer unit 22 a transfer direction designation signal for designating reverse transfer (step ST14 in FIG. 7).

During the above control by the CPU 15, the respective parts of the apparatus perform the following operations. Specifically, there are two types of LED printing heads 3 with opposite scan directions, and either type can be mounted. In other words, the LED printing head 3 to be mounted may be of the forward scan type in which right-to-left scan is carried out at the exposure position with respect to the direction of movement of the surface of the photosensitive drum 1, or may be of the reverse scan type in which left-to-right scan is carried out. The two types of LED printing heads 3 output different discrimination signals DIS with the same structure as in the first embodiment. For example, the forward scan type head outputs the discrimination signal DIS of a ground level, i.e. "L" level, and the reverse scan type head outputs the discrimination signal DIS of +5V, i.e. "H" level. At this time, the head type detection circuit 10 receives the discrimination signal DIS output from the LED printing head 3, determines whether the discrimination signal DIS is at "H" level or "L" level, and outputs the detection result.

If the forward scan type head is mounted as LED printing head 3, the head type detection circuit 10 informs the CPU 15 that the discrimination signal DIS is at "L" level. Then, the CPU 15 sets the transfer direction designation signal at "L" level and issues a command to the printing data transfer unit 22 to effect forward transfer of the printing data.

If a need to print an image arises in this state, the image processing unit 7 generates printing data on the basis of image data supplied from the outside. The generated printing data is temporarily stored in the page memory 8 and then supplied to the printing data transfer unit 22.

The printing data transfer unit 22 receives the printing data from the page memory 8 in units of one-line data and transfers the printing data to the LED printing head 3.

Figure 8:
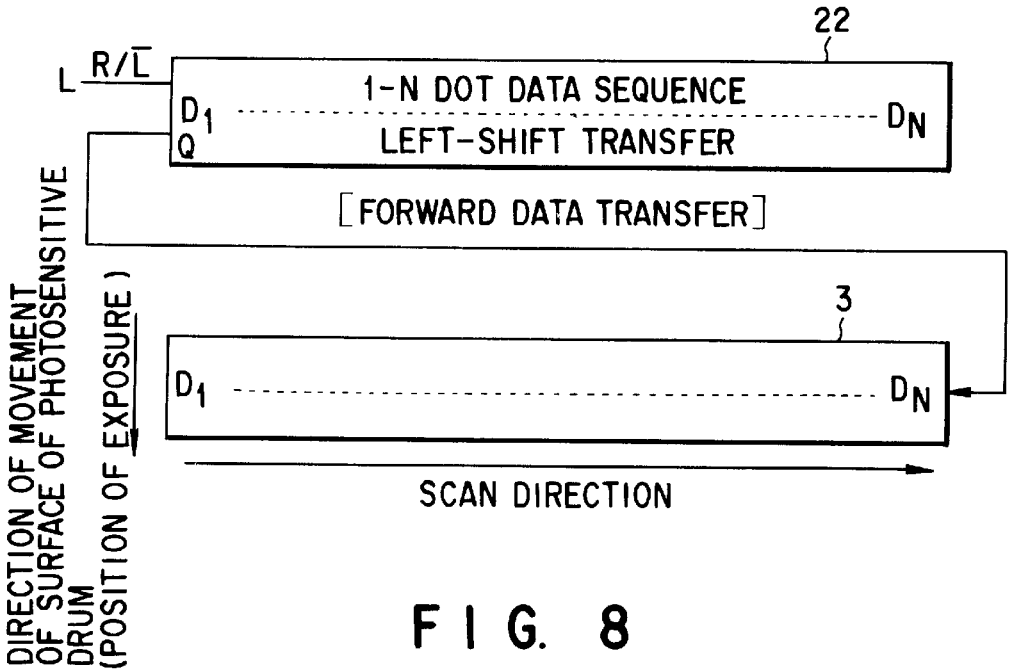
FIG. 8 illustrates printing data transfer from a printing data transfer unit to an LED printing head in the case where a forward scan type LED printing head is mounted.

The one-line printing data is N-bit ($D_1$ to $D_N$) data representing "black/white" of N-dots by value "1/0." Since the transfer direction designation signal is at "L" level, the printing data transfer unit 22 transfers to the LED printing head 3 the one-line printing data from data $D_1$ corresponding to the first dot, as shown in FIG. 8.

The LED printing head 3 receives the transferred printing data and controls the emission/non-emission of light of the N-number of LEDs in accordance with the value 1/0 of each bit, thus performing the exposure operation on the basis of the printing data. The bits are assigned to the LEDs such that the first transferred bit $D_1$ is associated with the first LED in the scan direction and the last transferred bit $D_N$ is associated with the last LED in the scan direction. Specifically, as shown in FIG. 8, the LED printing head 3 performs the exposure operation in the scan direction from bit $D_1$ towards bit $D_N$.

In this case, the other parts of the electrophotographic processing mechanism 100 are operated in the conventional operation mode. Thereby, the image is printed.

On the other hand, if the reverse scan type head is mounted as LED printing head 3, the head type detection circuit 10 informs the CPU 15 that the discrimination signal DIS is at "H" level. Then, the CPU 15 sets the transfer direction designation signal at "H" level and issues a command to the printing data transfer unit 22 to effect reverse transfer of the printing data.

If a need to print an image arises in this state, the image processing unit 7 generates printing data on the basis of image data supplied from the outside. The generated printing data is temporarily stored in the page memory 8 and then supplied to the printing data transfer unit 22.

Figure 9:
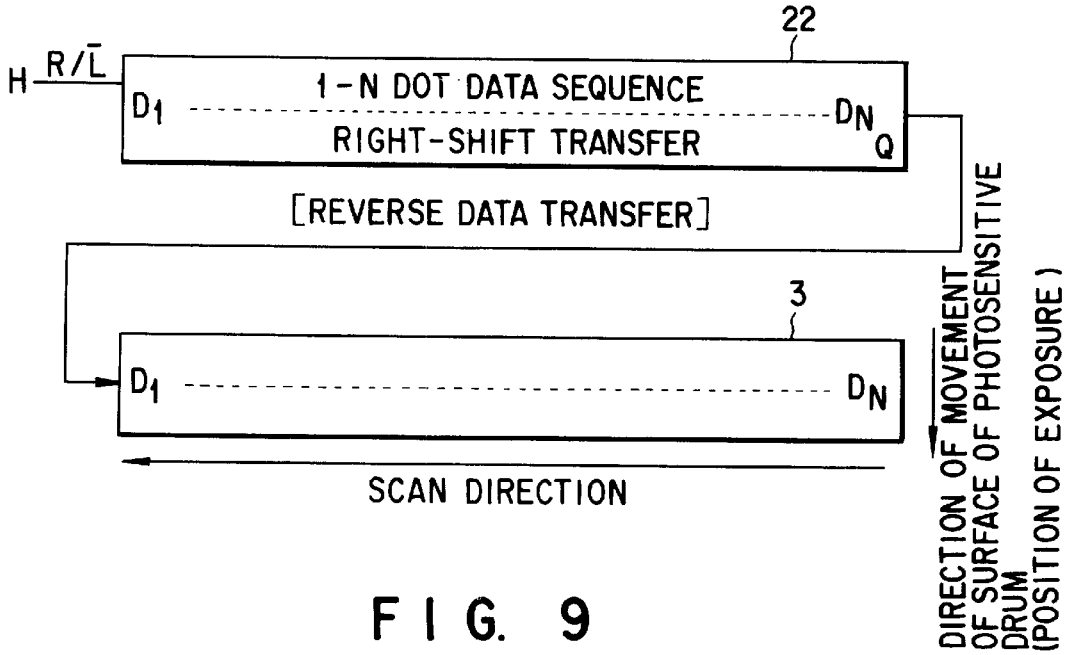
FIG. 9 illustrates printing data transfer from a printing data transfer unit to an LED printing head in the case where a reverse scan type LED printing head is mounted.

The printing data transfer unit 22 receives the printing data from the page memory 8 in units of one-line data and transfers the printing data to the LED printing head 3. Since the transfer direction designation signal is at "H" level, the printing data transfer unit 22 transfers to the LED printing head 3 the one-line printing data from data $D_N$ corresponding to the last dot, as shown in FIG. 9.

The LED printing head 3 receives the transferred printing data and controls the emission/non-emission of light of the N-number of LEDs in accordance with the value 1/0 of each bit, thus performing the exposure operation on the basis of the printing data. The bits are assigned to the LEDs such that the first transferred bit $D_N$ is associated with the first LED in the scan direction and the last transferred bit $D_1$ is associated with the last LED in the scan direction. Specifically, as shown in FIG. 9, the LED printing head 3 performs the exposure operation in the scan direction from bit $D_N$ towards bit $D_1$.

In this case, the other parts of the electrophotographic processing mechanism 100 are operated in the conventional operation mode. Thereby, the image is printed.

As has been described above, when the forward scan type head is mounted as LED printing head 3, the printing data transfer unit 22 transfers the printing data from the bit $D_1$ corresponding to the first dot, i.e. in the forward direction. When the reverse scan type head is mounted as LED printing head 3, the printing data transfer unit 22 transfers the printing data from the bit $D_N$ corresponding to the last dot, i.e. in the reverse direction.

The LED printing head 3 performs the exposure scan operation from the dot corresponding to the first transferred bit of the bits included in the one-line printing data towards the dot corresponding to the last transferred bit. In the case of the forward scan type head, the scan direction is from the right to the left with respect to the direction of movement of the photosensitive drum 1 at the position of exposure. Thus, the dot corresponding to the bit $D_1$ is located on the right side with respect to the direction of movement of the surface of the photosensitive drum 1. In the case of the reverse scan type head, the scan direction is from the left to the right with respect to the direction of movement of the photosensitive drum 1 at the position of exposure. Thus, the dot corresponding to the bit $D_1$ is located on the right side with respect to the direction of movement of the surface of the photosensitive drum 1. In other words, whether the LED printing head 3 is of the forward scan type or reverse scan type, the dot corresponding to the bit $D_1$ is always located on the right side with respect to the direction of movement of the surface of the photosensitive drum 1 at the position of exposure.

According to the present embodiment, therefore, the image can be exactly printed whether the forward scan type head or reverse scan head is mounted as LED printing head 3. Thus, either the forward scan type head or reverse scan head can be mounted as LED printing head 3. Even if shortage of supply of one of the two types of heads occurs, the other type of head may be substituted.

In addition, according to the present embodiment, the type of LED printing head 3 is automatically recognized and the direction of transfer of printing data is automatically switched. Thus, correct data transfer matching with the LED printing head 3 can always be performed.

Figure 10:
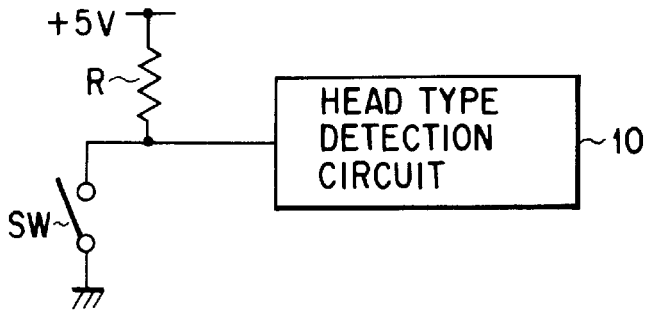
FIG. 10 shows a modification of the structure for recognizing the type of LED printing head.

The present invention is not limited to the above embodiments. For example, in the above embodiments, the LED having the function of outputting the discrimination signal is used, and the type of the mounted LED printing head 3 is automatically recognized from the discrimination signal output from the LED printing head 3. However, for example, a head type setting device comprising a resistor R and a switch SW, as shown in FIG. 10, may be provided on the printing apparatus body side and an output from the head type setting device may be detected by the head type detection circuit 10. Alternatively, the type of LED printing head 3 may be recognized on the basis of the designating operation through the operation unit 20. In this case, although it is necessary to perform the switching operation of the switch SW at the time of mounting the LED printing head 3, the LED printing head 3 without the function of outputting the discrimination signal can be used and the number of types of applicable heads increases. In addition, the number of signal lines and the number of pins of connectors can be decreased. The switch SW may be operated by a projection, etc. of the LED printing head 3.

Figure 11:
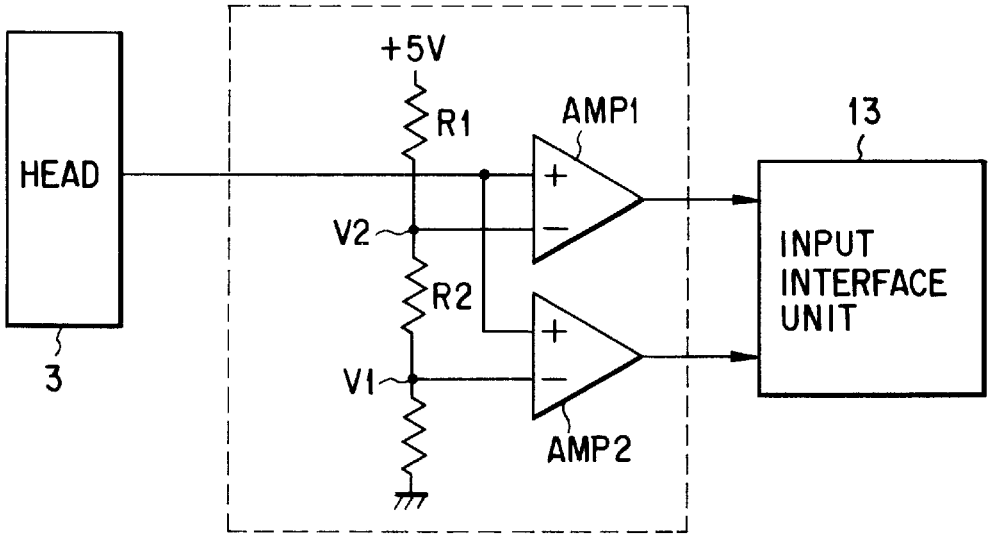
FIG. 11 shows an example of the structure of a head type detection circuit for detecting a multi-value recognition signal.
Figure 12:
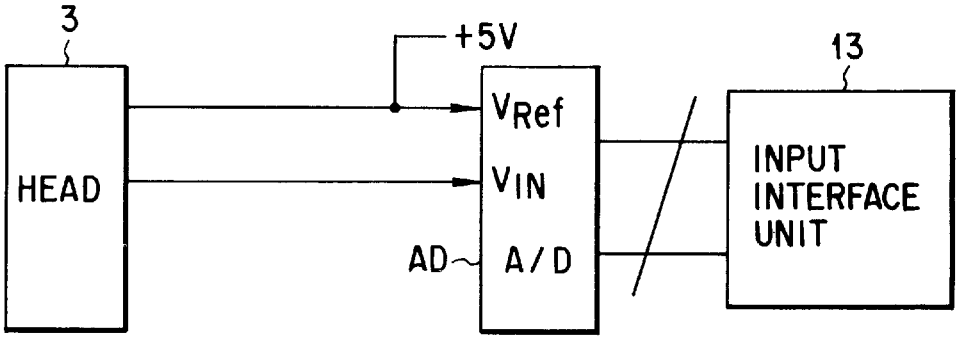
FIG. 12 shows another example of the structure of the head type detection circuit for detecting a multi-value recognition signal.

In the above embodiments, two types of LED printing heads 3 have been described as being applicable. However, three or more types of LED printing heads 3 may be applied. In this case, three or more kinds of discrimination signals need to be used, and binary data of two or more bits or multi-value signals may be used. FIGS. 11 and 12 show examples of the structure of the head type detection circuits 10 for detecting multi-value discrimination signals. FIG. 11 shows an example in which the level of the discrimination signal is detected by operational amplifiers AMP1 and AMP2, and FIG. 12 shows an example in which the level of the discrimination signal is converted to, and detected as, digital data by an A/D converter AD.

In the above embodiments, the control signals to be supplied to the LED printing head 3 are switched, depending on whether the LED printing head 3 is of the dynamic drive type or static drive type, or the direction of transfer of printing data is switched, depending on whether the LED printing head 3 is of the forward scan type or reverse scan type. However, the condition for recognizing the type of LED printing head 3 may be freely set. For example, the amount of energy to be supplied to the LED printing head 3 may be changed in accordance with the amount of energy necessary for obtaining optimal light amount, or the logic of control signal may be changed, depending on whether the LED printing head 3 is of the "active low" type or "active high" type.

In the above embodiments, the invention is applied to the electrophotographic printing apparatus wherein the LED printing head 3 is used as exposure apparatus. However, this invention is applicable to other electrophotographic printing apparatuses wherein, for example, a laser scanner or an LCD printing head is used. Furthermore, the present invention is applicable to a thermal printing apparatus in which a thermal printing head is used as printing head, or to printing apparatuses other than electrophotographic printing apparatuses.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A printing apparatus in which one of two types of printing heads with opposite scan directions is selectively mounted and the mounted printing head is supplied with printing data representing an image to be printed, thereby printing the image, said printing apparatus comprising:

a printing data transfer unit for transferring the printing data to the mounted printing head in one of an order from a beginning to an end of a scan line and an order from the end to the beginning of the scan line;

a head recognition unit for recognizing the type of the mounted printing head; and a transfer control unit for enabling the printing data transfer unit to transfer the printing data in the order associated with the type of the mounted printing head recognized by the head recognition unit.

2. The printing apparatus according to claim 1, wherein said transfer control unit includes a central processing unit which receives a signal from said head recognition unit in correspondence with the type of the mounted printing head that is recognized and controls the printing data transfer unit to transfer the printing data in the order associated with the type of the mounted printing head recognized by the head recognition unit.

3. The printing apparatus according to claim 1, further comprising:

an image processing unit for receiving data to be printed and for generating printing data for driving the printing head; and a memory for storing one page of said data from said image processing unit and for transferring one line of said stored page at a time to said printing data transfer unit.

4. The printing apparatus according to claim 3, wherein said printing data transfer unit includes a bi-directional shift register which transfers each line from said memory in a forward direction or a reverse direction in dependence upon an output signal from said transfer control unit, corresponding to the type of the mounted printing head recognized by the head recognition unit.

5. The printing apparatus according to claim 1, wherein said printing data transfer unit includes a bi-directional shift register which is controlled by said transfer control unit to transfer the printing data in a forward direction or a reverse direction in dependence upon an output signal from said transfer control unit, corresponding to the type of the mounted printing head recognized by the head recognition unit.

6. The printing apparatus according to claim 1, wherein said plurality of types of printing heads are provided with predetermined discriminators which differ from each other in accordance with the types of the printing heads, and said head recognition unit recognizes the type of the mounted printing head on the basis of the associated discrimination unit.

7. The printing apparatus according to claim 6, wherein each said discrimination unit provides electric signals having levels different from each other.

8. The printing apparatus according to claim 1, wherein an LED printing head is used as each said printing head and the image is printed in an electrophotographic printing method.

9. A printing apparatus in which one of two types of printing heads with opposite scan directions is selectively mounted and the mounted printing head is supplied with printing data representing an image to be printed, thereby printing the image, said printing apparatus comprising:

printing data transfer means for transferring the printing data to the mounted printing head in one of an order from a beginning to an end of a scan line and an order from the end to the beginning of the scan line;

head recognition means for recognizing the type of the mounted printing head; and transfer control means for enabling the printing data transfer means to transfer the printing data in the order associated with the type of the mounted printing head recognized by the head recognition means.

10. The printing apparatus according to claim 9, wherein said transfer control means includes a central processing unit which receives a signal from said head recognition means in correspondence with the type of the mounted printing head that is recognized and controls the printing data transfer means to transfer the printing data in the order associated with the type of the mounted printing head recognized by the head recognition means.

11. The printing apparatus according to claim 9, further comprising:

an image processing unit for receiving data to be printed and for generating printing data for driving the printing head; and a memory for storing one page of said data from said image processing unit and for transferring one line of said stored page at a time to said printing data transfer means.

12. The printing apparatus according to claim 11, wherein said printing data transfer means includes a bi-directional shift register which transfers each line from said memory in a forward direction or a reverse direction in dependence upon an output signal from said transfer control means, corresponding to the type of the mounted printing head recognized by the head recognition means.

13. The printing apparatus according to claim 9, wherein said printing data transfer means includes a bi-directional shift register which is controlled by said transfer control means to transfer the printing data in a forward direction or a reverse direction in dependence upon an output signal from said transfer control means, corresponding to the type of the mounted printing head recognized by the head recognition means.

14. The printing apparatus according to claim 9, wherein said plurality of types of printing heads are provided with predetermined discrimination means which differ from each other in accordance with the types of the printing heads, and said head recognition means recognizes the type of the mounted printing head on the basis of the associated discrimination means.

15. The printing apparatus according to claim 14, wherein said discrimination means provide electric signals having levels different from each other.

16. The printing apparatus according to claim 9, wherein an LED printing head is used as each said printing head and the image is printed in an electrophotographic printing method.

* * * * *